United States Patent [19]

Drori

[11] 3,966,122

[45] June 29, 1976

[54] NON-SIDE-SPLASH WATER SPRINKLERS

[76] Inventor: Mordeki Drori, 89 Zahal St., Kiron, Israel

[22] Filed: Apr. 9, 1975

[21] Appl. No.: 566,275

[30] Foreign Application Priority Data

Aug. 30, 1974 Israel ..... 45573

[52] U.S. Cl. ..... 239/233; 239/264

[51] Int. Cl.[2] ..... B05B 3/08

[58] Field of Search ..... 239/225, 230–233, 239/264

[56] References Cited

UNITED STATES PATENTS

| | | | |
|---|---|---|---|
| 3,391,868 | 7/1968 | Cooney | 239/233 X |
| 3,581,994 | 6/1971 | Heiberger | 239/233 X |
| 3,746,259 | 7/1973 | Apri | 239/230 X |
| 3,831,853 | 8/1974 | Drori | 239/233 X |

*Primary Examiner*—Evon C. Blunk
*Assistant Examiner*—Andres Kashnikow
*Attorney, Agent, or Firm*—Benjamin J. Barish

[57] ABSTRACT

A non-side-splash water sprinkler, including a sprinkler head rotatably mounted on a supply pipe, a nozzle from which the water issues in the form of a jet, and an oscillating arm drive member impinged by the water jet for rotating the head, is characterized in that it includes a splash guard carried by the sprinkler head at a location to substantially block sidesplash from the oscillating arm, and in that the rotational axis of the sprinkler head is substantially aligned with the general vicinity of impingement of the water splashed against the splash-guard such that little or no rotary torque is applied to the sprinkler head by the impingement of the water splashed against the splash-guard. A preferred embodiment of the invention is described in which a conventional sprinkler head is easily converted for non-side-splash operation by merely attaching the splash-guard and by providing a horizontal pipe for displacing the sprinkler rotational axis forwardly of the oscillating arm pivotal axis.

12 Claims, 7 Drawing Figures

NON-SIDE-SPLASH WATER SPRINKLERS

BACKGROUND OF THE INVENTION

The present invention relates to water sprinklers, and particularly to sprinklers of the type including a drive member, such as an oscillating arm, impinged by the water jet for driving the sprinkler head about a rotational axis.

In the conventional sprinklers of the foregoing type, the impingement of the water jet on the oscillating arm drive member causes considerable water splash laterally of the water jet line. When the sprinkler is of the sector-type, namely one including a reversing mechanism cooperable with positionable stops to cause the sprinkler head to oscillate over a preselected arc, the side-splash wets surfaces (e.g. the road or sidewalk along which the sprinklers are installed) which may not only be undersirable to be wetted, but may also create nuisances or hazardous conditions if wetted.

A number of arrangements have been proposed for preventing or reducing this side-splash. One known arrangement includes an S-shaped reaction member carried by the oscillating arm for confining the water discharge to the preselected arc. Another arrangement, described in my U.S. Pat. No. 3,831,853, includes baffles or splash-guards, and a laterally-offset mounting for the oscillating arm to produce the rotational torque. Such arrangements, however, while effective to limit or prevent side-splash, require extensive modification to the design of the conventional sprinkler head, and therefore involve substantial retooling costs for their manufacture.

SUMMARY OF THE INVENTION

A broad object of the present invention is to provide a new arrangement for preventing or reducing side-splash in in water sprinklers of the foregoing type.

A further object of one of the embodiments described below is to provide the non-side-splash feature to various standard sprinkler head constructions, requiring merely a simple and inexpensive modification to adapt them for the non-side-splash function.

The invention is described herein with respect to a water sprinkler including a sprinkler head mountable to a supply pipe for movement about a rotational axis, a nozzle carried by the sprinkler head from which the water issues in the form of a jet, and a drive member carried by the sprinkler head and impinged by the water jet for driving the head about its rotational axis.

According to one feature of the invention the sprinkler includes a splash guard carried by the sprinkler head at a location to be impinged by the water splashed laterally from the drive member to substantially block side-splash therefrom. Also, the rotational axis of the sprinkler head is substantially aligned with the general vicinity of impingement of the water splashed against the splash-guard such that little or no rotary torque is applied to the sprinkler head by the impingement of the water splashed against the splash guard.

According to a further feature, the sprinkler is one wherein the drive member is an oscillating arm which strikes the sprinkler head and which is mounted on a pivotal axis substantially rearwardly of the rotational axis of the sprinkler head.

According to a still further feature, the sprinkler head is supported by means of a mounting comprising a conduit rotatably mountable on its forward end to the supply pipe and carrying on its rearward end the sprinkler head.

In a described embodiment, the conduit is a horizontal pipe including a downwardly extending coupling at its forward end for rotatably mounting same to the supply pipe, and an upwardly extending coupling at its rearward end for fixedly securing the sprinkler head thereto.

It will thus be seen that the provision of the splash-guard produces substantially no-rotary torque during the operation of the sprinkler, and therefore does not affect the operation of the oscillating arm to rotate the sprinkler in the conventional manner. Accordingly, a conventional sprinkler construction can be adapted for non-side-splash operation by merely attaching the splash-guard to the sprinkler housing or forming it integrally therewith, and providing the above-mentioned horizontal pipe for displacing the sprinkler rotational axis forwardly of the oscillating arm pivotal axis.

The invention may also be embodied in non-standard sprinklers specially designed to include the above non-side-splash feature.

Where the sprinkler is of the standard type, the rotational axis of the sprinkler head would be substantially aligned with the general vicinity of the impingement of the water splashed against the splash-guard such that little or no rotary torque is applied to the sprinkler head by the impingement of the water splashed against the splash-guard. In such a design, the nozzle would be located substantially at the pivotal axis of the oscillating arm, as is conventional in the standard sprinkler.

Another embodiment of the invention described above, however, involves a redesigned sprinkler, wherein the nozzle is located at substantially the rotational axis of the sprinkler head.

Further features and advantages of the invention will be apparent from the description below.

BRIEF DESCRIPTION OF THE DRAWINGS

The invention is herein described, by way of example only, with reference to two embodiments illustrated in the accompanying drawings, wherein.

DESCRIPTION OF THE PREFERRED EMBODIMENTS

EMBODIMENT OF FIGS. 1–3

Figure 1:
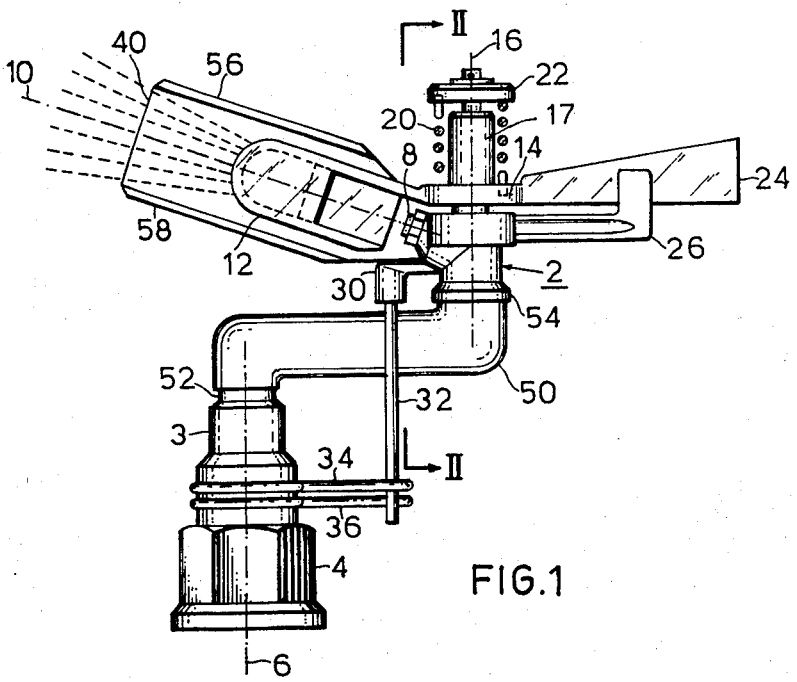
FIG. 1 is a side elevational view of a preferred form of water sprinkler constructed in accordance with the invention.
Figure 2:
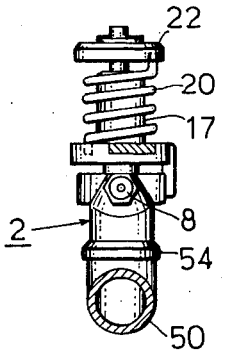
FIG. 2 is a sectional view along lines II—II of FIG. 1.
Figure 3:
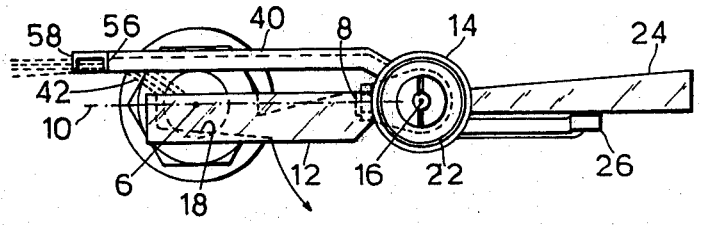
FIG. 3 is a top plan view of the sprinkler FIG. 1.

The sprinkler illustrated in FIGS. 1–3 of the drawings includes a head, generally designated 2, rotatably mountable via a fitting 3 and a threaded nut 4 to a vertical water supply pipe (not shown) so as to be rotatable about the vertical axis 6. The sprinkler head carries a nozzle 8 from which the water supplied by the supply pipe issues in the form of a jet along nozzle axis 10.

It will be seen from FIG. 3 that nozzle axis 10 is substantially in the same vertical plane as the rotational axis 6 of the sprinkler, so that substantially no rotary torque results from the reaction forces produced by the discharge of the water jet from nozzle 8. In some cases, however, it may be desireable to displace nozzle axis 10 slightly from the vertical plane of the rotational axis 6, so as to produce a slight reaction force tending to rotate the sprinkler head.

The sprinkler is rotated by a drive member in the form of an oscillating arm 12 having a central hub 14 pivotable about a vertical axis 16 defined by a pin 17 carried by the sprinkler head 2. Arm 12 is driven in one direction (counter-clockwise in FIG. 3) by the impingement of the water jet against an inclined face 18 carried at one end of the arm, and is returned in the opposite direction by a spring 20 fixed between oscillating arm 12 and a collar 22 carried at the upper end of pin 17. A hammer 24 is carried at the opposite end of arm 12 and strikes an abutment 26 fixed to the sprinkler head 2 during the return stroke of each oscillatory movement of the arm. This causes the sprinkler head to rotate about axis 6 (clockwise in FIG. 3) in a series of short angular movements.

The sprinkler further includes a reversing mechanism of known construction, and generally designated as 30 in FIG. 1, cooperable via a depending leg 32 with a pair of positionable stops 34, 36. The sprinkler head reverses its movement each time leg 32 engages one of the stops 34, 36, and thereby oscillates only through a preselected arc.

The foregoing construction of the sprinkler head insofar as described above is quite conventional, and therefore further details are not deemed necessary.

According to the present invention, the sprinkler head is provided with a splash-guard 40 located so as to be impinged by the water splashed laterally (as shown at 42, FIG. 3) from inclined surface 18 of the oscillating arm 12. Splash-guard 40 substantially blocks the side-splash of the water from the oscillating arm, and thus prevents the undesirable wetting of areas outside of the predetermined watering sector of the sprinkler.

In the conventional sprinkler construction, however, splash-guard 40 would also tend to produce a rotary torque working at times against the rotary torque produced by the oscillating arm, and therefore would prevent the oscillating arm from rotating the sprinkler head in both the forward and return movements to water the preselected sector. This undesirable effect is prevented or substantially reduced in the sprinkler illustrated in FIGS. 1–3 by an arrangement for mounting the sprinkler head to the supply pipe such that the rotational axis 6 of the sprinkler head is substantially aligned with the general vicinity of impingement of the water splashed against the splash-guard 40, so that little or no rotary torque is produced on the sprinkler head by the impingement of the splashed water against the splash-guard.

For the latter purpose, the sprinkler illustrated in the drawings includes a conduit 50 in the form of a horizontal pipe having a downwardly extending coupling 52 at its forward end for rotatably mounting same to the fitting 3 (which is attached by nut 4 to the supply pipe) and further having, at its rear end, an upwardly extending coupling 54 fixedly attached to the sprinkler head 2. Pipe 50 thus displaces the rotational axis 6 of the sprinkler forwardly of the pivotal axis 16 of the oscillating arm 12, and also forwardly of the nozzle 8, such that the rotational axis 6 is substantially aligned with the area of impingement of the water 42 splashed from surface 18 of the oscillating arm 12 against splash-guard 40. Thus, since the force produced by this splashed water against the splash-guard 40 is substantially aligned with the axis of rotation 6 of the sprinkler head 2, this splashed water will produce a negligible rotary moment with respect to the sprinkler head. Accordingly, it will not affect the normal operation of the oscillating arm 12, of oscillating the sprinkler head under the control of the sector-determining stops 34, 36.

Pipe 50 may be constructed so that its rearward end 54 mates with the conventional sprinkler head 2 and its forward end 52 mates with the conventional fitting 3, so that any conventional sprinkler can be adapted for non-side-splash operation by merely inserting pipe 50 between the normally-mating parts of sprinkler head 2 and fitting 3, and by providing the splash-guard 40. The latter may be supplied as a separate plate attachable to the sprinkler head by fasteners, or may be integrally formed with the sprinkler head at the time of manufacture, particularly where the latter is made of plastic.

Splash-guard 40 may be of a simple vertical plate preferably including a pair of inwardly-directed flanges 56, 58 at opposite sides to more effectively block the side-splash.

In the sprinkler illustrated in FIGS. 1–3 of the drawings, the rotational axis 6 of the sprinkler head, the pivotal axis 16 of the oscillating arm, and the nozzle axis 10 are all illustrated as being coplanar; also, the rotational axis 6 is illustrated as being substantially in alignment with the area of impingement of the splashed water 42 against the splash-guard 40. This would be the preferred arrangement, theoretically. However, some variation in the foregoing relationship can be tolerated, and may ever be desirable, in producing the optimum rotational torque for any particular application.

EMBODIMENT OF FIGS. 4 AND 5

Figure 4:
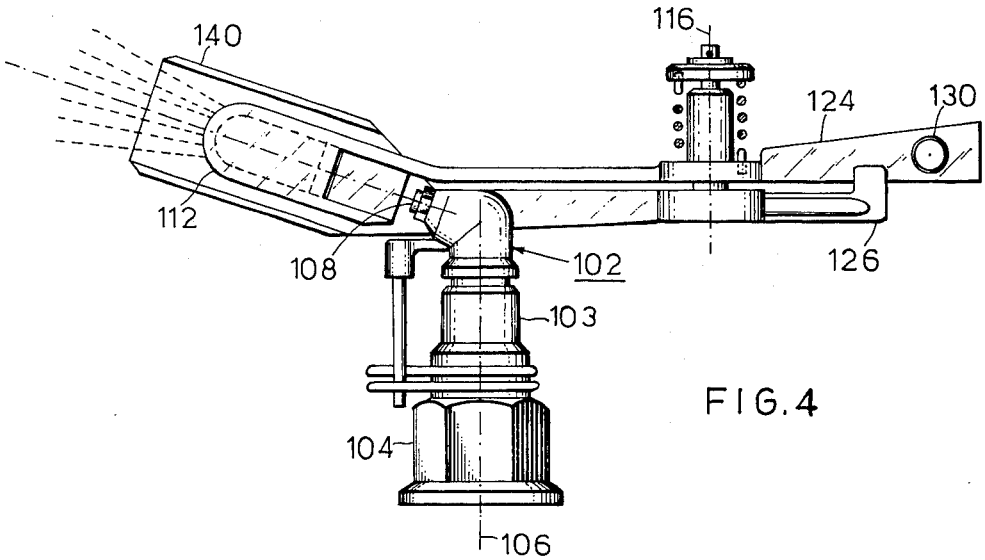
FIGS. 4 and 5 are side and top views respectively of another form of sprinkler constructed in accordance with the invention.
Figure 5:
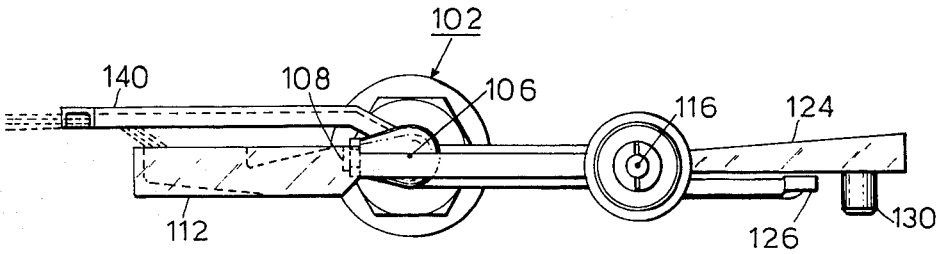

The sprinkler illustrated in FIGS. 4 and 5 of the drawings is a non-standard sprinkler, but one including the non-side-splash feature of the sprinkler described above with respect to FIGS. 1–3.

The sprinkler of FIGS. 4 and 5 thus also includes a head 102 rotatably mountable on a fitting 103 attached by a threaded nut 104 to a water supply pipe (not shown) so as to be rotatable about the vertical axis 106. The sprinkler head carries a nozzle 108, an oscillating arm 112 pivotable about axis 116 to cause its hammer 124 to strike an abutment 126 for rotating the sprinkler, and a splash-guard 140 located to be impinged by the water splashed laterally from the ascillating arm.

The embodiment of FIGS. 4 and 5, however, is a specially-designed sprinkler wherein the nozzle 108 is located substantially at the rotational axis 106 of the sprinkler head. In this embodiment, while a small rotary torque will be produced by the impingement of the splashed water against the splashguard 140, this torque will be very substantially less than the torque produced by the striking of the oscillating arm 112 against the sprinkler head stop 126, because of the substantially larger length of the oscillating arm 112. Accordingly, the smaller torque produced by the splash-guard will not affect the operation of the oscillating arm from rotating the sprinkler head about the rotational axis 106 in the same manner as described above. This embodiment preferably includes a weight 130 to increase the impact when the hammer 124 strikes the head abutment 126.

Figure 7:
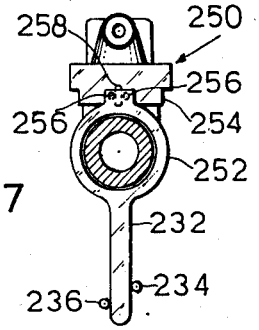
FIG. 7 is a sectional view along lines VII—VII of FIG. 6.
Figure 6:
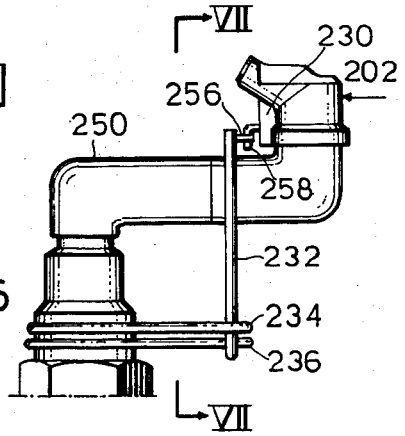
FIG. 6 is a side elevational view of a modification in the sprinkler of FIGS. 1–3.

VARIATION OF FIGS. 6 and 7

FIGS. 6 and 7 illustrate a further variation particularly useful with respect to the embodiment of FIGS. 1–3 illustrating how a standard sprinkler head may be modified in a simple and inexpensive manner to include the non-side-splash feature.

In the standard sprinkler, the stops (34, 36, FIG. 1) cooperable with the leg (32) of the standard reversing mechanism (30) are normally disposed forwardly of the rotational axis (6) of the sprinkler. However, when the sprinkler head is provided with the horizontal pipe (50, FIG. 1) to provide the non-side-splash feature described above, it is more convenient to have the stops (34, 36) disposed on the opposite side of the sprinkler axis (6), i.e., to underlie the horizontal pipe as shown in FIG. 1. In such a case the reversing mechanism would be actuated by the stops in the opposite manner from the standard sprinkler.

This may be easily corrected, if desired, by supporting the depending leg 32 so that its actuation by the stops 34, 36 will be reversed.

The foregoing variation is illustrated in FIGS. 6 and 7, wherein it will be seen that the previously-mentioned depending leg is in the form of a lever 232 pivotably mounted on the horizontal pipe 250, the upper end of the lever being formed with a ring 252 enclosing pipe 250, and with a short arm 254 cooperable with the standard reversing mechanism 230. Arm 254 includes a pair of spaced pins 256 straddling an operator 258 of the reversing mechanism 230, such that when the lower end of lever 232 is pivoted in one direction for engagement with one of the stops 234, 236, its upper arm 254 is moved in the opposite direction to actuate operator 258 of the reversing mechanism 230. Thus, the stops 234, 236, even though positioned on the rearward side of the rotational axis 206 of the sprinkler head 202 will actuate the standard reversing mechanism 230 to reverse the movement of the sprinkler head in the same manner as in the conventional head.

While the abutment (26 in FIGS. 1–3, and 126 in FIGS. 4 and 5) has been shown on the rearward side of the pivotal axis of the oscillating arm, it will be appreciated that the abutment could be on the forward side of this axis, i.e., on the same side as the face of the arm impinged by the water jet.

Many other changes, variations, and applications of the illustrated embodiment will be apparent.

What is claimed is:

1. A water sprinkler including a sprinkler head mountable to a supply pipe for movement about a rotational axis, a nozzle carried by the sprinkler head from which the water issues in the form of a jet, and a drive member carried by the sprinkler head and impinged by the water jet for driving the head about said rotational axis, characterized in that the sprinkler includes a splash guard carried by the sprinkler head at a location to be impinged by the water splashed laterally from the drive member to substantially block side-splash therefrom, and that the sprinkler head is rotatably mounted on a rotational axis which is substantially aligned with the general vicinity of impingement of the water splashed against the splash-guard such that little or no rotary torque is applied at anytime to the sprinkler head by the impingement of the water splashed against the splash-guard during the rotation of the sprinkler head about its rotational axis by said drive member.

2. A sprinkler according to claim 1, wherein the drive member is an oscillating arm which strikes the sprinkler head and which is mounted on a pivotal axis substantially rearwardly of the rotational axis of the sprinkler head.

3. A sprinkler according to claim 2, wherein the sprinkler head is supported by means of a mounting comprising a conduit rotatably mountable on its forward end to the supply pipe and carrying on its rearward end the sprinkler head.

4. A sprinkler according to claim 3, wherein said conduit is a horizontal pipe including a downwardly extending coupling at its forward end for rotatably mounting same to the supply pipe, and an upwardly extending coupling at its rearward end for fixedly securing the sprinkler head thereto.

5. A sprinkler according to claim 4, wherein the sprinkler head includes a reversing mechanism cooperable with stops to cause the head to oscillate through preselected arcs, the sprinkler further including a lever pivotably mounted on said horizontal pipe, the lower end of said lever being engageable with said stops, and the upper end of the lever being engageable with said reversing mechanism.

6. A sprinkler according to claim 1, wherein the sprinkler head includes a reversing mechanism cooperable with stops to cause the head to oscillate through preselected arcs.

7. A sprinkler according to claim 1, wherein the rotational axis of the sprinkler head, the pivotal axis of the oscillating arm, and the nozzle axis, are all substantially coplanar.

8. A sprinkler according to claim 1, wherein said splash-guard comprises a vertical plate and a pair of inwardly-directed flanges at opposite sides thereof.

9. A water sprinkler including a sprinkler head mountable to a supply pipe for movement about a rotational axis, a nozzle carried by the sprinkler head from which the water issues in the form of a jet, a drive member carried by the sprinkler head and impinged by the water jet for driving the head about said rotational axis, and a reversing mechanism cooperable with stops to cause the head to oscillate through a preselected arc; characterized in that the sprinkler includes a splash-guard carried by the sprinkler head at a location to be impinged by the water splashed laterally from the drive member to substantially block side-splash therefrom, and that the drive member is an oscillating arm which strikes the sprinkler head and which is mounted on a pivotal axis substantially rearwardly of the rotational axis of the sprinkler head such that the torque produced by the oscillating arm tending to rotate the sprinkler head about its rotational axis is substantially greater than and overcomes the torque produced by the impingement of the water splashed against the splash-guard.

10. A sprinkler according to claim 9, wherein the sprinkler head is rotatably mounted on a rotational axis which is substantially aligned with the general vicinity of the impingement of the water splashed against the splash-guard such that little or no rotary torque is applied at any time to the sprinkler head by the impingement of the water splashed against the splash-guard during the rotation of the sprinkler head about its rotational axis by said drive member.

11. A sprinkler according to claim 10 wherein the nozzle is located substantially at the pivotal axis of the oscillating arm.

12. A sprinkler according to claim 9, wherein the nozzle is located substantially at the rotational axis of the sprinkler head.

The remaining structure, including the reversing mechanism for producing the sector-distribution of the water, would be substantially the same as described above with reference to FIGS. 1–3.

As in the case of the sprinkler of FIGS. 1–3, the pivotal axis 116 of the oscillating arm 112 is also rearwardly of the rotational axis 106 of the sprinkler head, so that the torque produced by the oscillating arm tending to rotate the sprinkler head about axis 106 is substantially greater than and overcomes the torque produced by the impingement of the water splashed against the splash-guard 140. In the embodiment of FIGS. 1–3, however, the rotational axis 6 of the sprinkler is substantially aligned with the general vicinity of the impingement of the water 42 splashed against the splash-guard 40, such that little or no rotary torque was produced on the sprinkler head by the latter. Such an arrangement, as pointed out above, is particularly useful with standard sprinklers wherein the nozzle 8 is located substantially at the pivotal axis of the oscillating arm.

* * * * *